US009243435B1

(12) United States Patent
Kaounas

(10) Patent No.: US 9,243,435 B1
(45) Date of Patent: Jan. 26, 2016

(54) SAFETY FALL ARRESTOR AND WIND LOCK FOR VERTICAL LIFT DOORS

(71) Applicant: John Kaounas, Canton, MI (US)

(72) Inventor: John Kaounas, Canton, MI (US)

( * ) Notice: Subject to any disclaimer, the term of this patent is extended or adjusted under 35 U.S.C. 154(b) by 0 days.

(21) Appl. No.: 14/490,120

(22) Filed: Sep. 18, 2014

(51) Int. Cl.
*E05D 13/00* (2006.01)
*E05D 15/24* (2006.01)

(52) U.S. Cl.
CPC ..... *E05D 13/006* (2013.01); *E05D 13/1238* (2013.01); *E05D 13/1246* (2013.01); *E05D 15/242* (2013.01)

(58) Field of Classification Search
USPC ..... 49/322
IPC ..... E05D 13/003,13/006, 13/1246, 13/1292
See application file for complete search history.

(56) References Cited

U.S. PATENT DOCUMENTS

| | | | | | |
|---|---|---|---|---|---|
| 943,850 | A * | 12/1909 | Troike | 187/367 |
| 1,998,233 | A * | 4/1935 | Greegor | 49/322 |
| 2,084,677 | A * | 6/1937 | Gerken | 49/204 |
| 4,368,770 | A | 1/1983 | Ulfhielm | |
| 4,696,375 | A * | 9/1987 | Matthews et al. | 187/313 |
| 4,854,077 | A * | 8/1989 | Rogers et al. | 49/322 |
| 6,485,068 | B1 * | 11/2002 | Sauve | 292/171 |
| 6,553,716 | B2 | 4/2003 | Bruns | |
| 2012/0186158 | A1 * | 7/2012 | Sanke | 49/322 |

* cited by examiner

*Primary Examiner* — Gregory Strimbu
(74) *Attorney, Agent, or Firm* — Dinsmore & Shohl LLP; Allen M. Krass

(57) ABSTRACT

A fall arrestor for use with a vertical lift door includes a pair of latching dogs selectively pivoted into and out of contact with a vertical rail by cam members and a compression mechanism actuated by a change in tension between a lift cable and the vertical lift door. The fall arrestor further includes a ground locking system for locking the door when the vertical lift door is completely closed. The fall arrestor is capable of preventing of free fall of the vertical lift door in a catastrophic failure of a lift mechanism or the lift cable.

12 Claims, 6 Drawing Sheets

SAFETY FALL ARRESTOR AND WIND LOCK FOR VERTICAL LIFT DOORS

FIELD OF THE INVENTION

The invention relates to a safety fall arrestor and securing device for vertical lift doors. More specifically, the invention relates to such a device for use on vertical lift doors for improving their safety performance by preventing free fall of the vertical lift door in the event of a catastrophic failure of the lifting mechanism and securing the vertical lift door in closed position.

BACKGROUND OF THE INVENTION

Vertical lift doors are used in a variety of industries where structures require large doorways. For example: aircraft hangars require hangar doors large enough for an aircraft to pass through, factories often require large doorways for receiving materials and equipment as well as the exiting of finished products.

The type of vertical lift door for such applications may vary based on specific industry requirements, structural support capacity, or the intended environment. Generally, two types of vertical lift doors are common. First, a hoist up fabric door and second, a metal clad paneled vertical lift door. Regardless of the type of vertical lift door, the doors are typically constructed with multiple panels spanning the width of the building opening. Additionally, each panel may weigh 100 lbs or more, with many over 1,000 lbs.

In order to lift and lower these large vertical lift doors, a lift mechanism usually in the form of a power driven motor is connected through a cable or similar retractable tension bearing member to each side of the door. The cable may feed through pulleys or brackets on separate panels to create uniform lifting where each panel's vertical travel is relative to the other panels.

The heavy weight of the door and its inherent exposure to adverse environmental conditions lead to substantial lift cable and lift mechanism wear. In the event of a catastrophic failure occurring as a result of a break in the lift cable or failure of the lift mechanism, significant damage to the vertical lift door or the building structure may occur, as well as possible injury to individuals or damage to goods in the vicinity of the failed door.

To obviate the effects of such catastrophic failures, safety catch systems have been devised to prevent free fall of the vertical lift doors. One form of fall arrestor is disclosed in U.S. Pat. No. 4,368,770 to Ulfhielm, which utilizes a vertical guide bar extending along an edge of the door and having a U-shaped cross section. A compression spring is normally compressed as a result of the door weight and tension applied by a lift cable. When the lift mechanism fails and the door begins to fall, the spring expands and actuates a pair of latching dogs which extend away from each other against opposite sides of the U-shaped guide bar. However, the latching dogs extending in opposite directions from each other against the opposed sides of the U-shaped guide bar may fail to provide a reliably strong binding effect in the event of a catastrophic failure of the cable or cable lift apparatus. The forces applied by the dogs to opposing sides of the guide rail may result in deformation of the U-shaped guide bar and significant structural damage to the vertical doorframe.

Another form of vertical door fall arrestor is disclosed in U.S. Pat. No. 6,553,716 to Bruns which discloses a safety catch system comprising a vertical guide rail configured between a pair of latching dogs that are positioned free of the guide rail through a biasing mechanism and selectively actuated by a control arm connected to a lift cable and lift mechanism. In the event of a catastrophic failure of the cable mechanism, a torsion spring surrounding an axle connected at one end to the latching dogs and at the other end to a stay/release mechanism rotates the latching dogs into contact with the guide rail. Due to the infrequent activation of the biasing mechanism and its exposure to adverse environmental conditions, the system is prone to corrosion and contamination preventing reliable activation and binding to the guide rail in the event of a catastrophic failure. Furthermore, a direct drive connection such as a torsion spring mounted on an axle which the spring must rotate in a catastrophic failure requires greater torque than a compression spring utilizing a cam mechanism to pivot the latching dogs.

SUMMARY OF THE INVENTION

The present invention solves these problems in the prior art by providing an improved fall arrestor and wind lock device.

The preferred embodiment of the fall arrestor comprises a pair of latching dogs supported on an edge of the door on opposed sides of a vertical guide rail. In normal operation of the door, a pair of compression springs which are supported on the fall arrestor fixed to the door are moved to a compressed position by a mechanism that is connected to the door and accordingly exerts the weight of the door on one end of the springs and a bar connected to the end of the cable which exerts an opposed force on the other end of the springs. When the cable or drive mechanism fails and its force is no longer exerted on the springs, the springs expand and a pair of cams pivotably supported on the lifting bar and connected to the pivotable latching dogs force the latching dogs into the locked position in which they engage opposed sides of the guide rail and prevent motion of the door.

Accordingly, it is an object of the invention to provide a fall arrestor with improved reliability in activation and binding to a vertical rail and minimizing structural damage while preventing movement of the vertical lift door in a catastrophic failure.

The pair of latching dogs optionally includes a bottom portion having a recess to smoothly latch on a safety lock shaft fixed at the base of the doorframe adjacent to the vertical side of the vertical lift door. The pair of latching dogs optionally further include flame-hardened teeth for strong binding to the vertical rail when pivoted to the closed position.

Various objects, features, aspects, and advantages of the present invention will become more apparent from the following detailed description or preferred embodiments of the invention, along with the accompanying drawings in which like numerals represent like components.

DETAILED DESCRIPTION OF THE INVENTION

Figure 1:
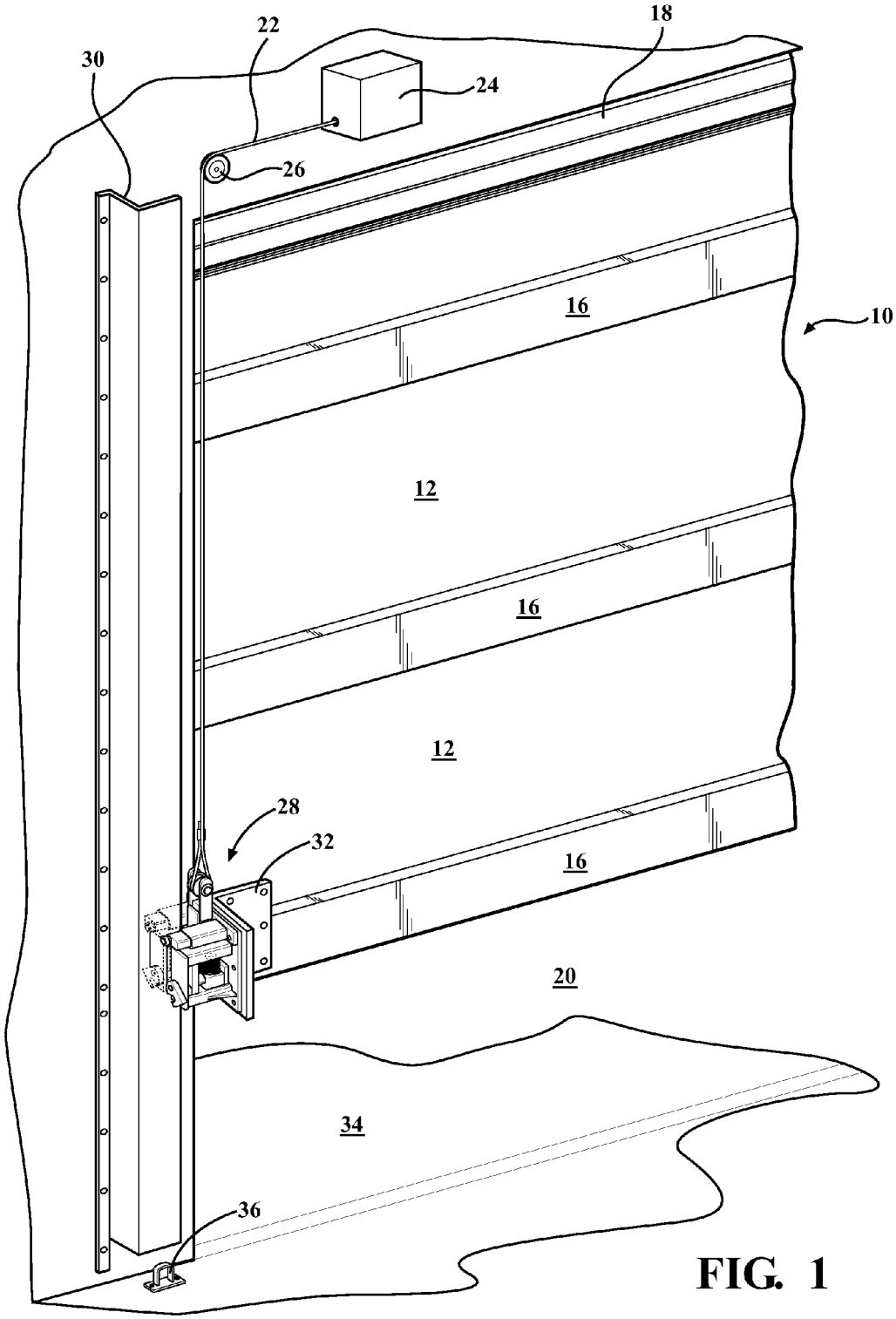
FIG. 1 is a view of a vertical lift door assembly including the inventive fall arrestor.

A preferred embodiment of the invention, illustrated generally in FIG. 1, is used in connection with a conventional, multi-panel vertical lift door. The door 10 has a number of panels 12 arranged one above the other and connected by horizontal hinge sections 16. The top panel is supported by a bracket 18 extending horizontally across the top of an opening 20 to be closed by the door.

The door may be lifted and lowered by a cable 22 connected to a power drive 24. The cable can take the form of any flexible tension member including a wire, cable, rope, chain, or strap. The cable is arrayed over a pulley 26 rotatably supported on one wall of the building and extends downwardly to a fall arrestor, generally indicated at 28, which is fixed to the lowest bar 16 of the door 10. The drive 24 acts to raise and lower the door by retracting or lowering the cable.

A vertically extending L-shaped guide rail 30 is secured to the wall of the building alongside the edge of the door which carries the fall arrestor 24. The lower end of the guide rail 30 terminates a short distance above the floor 34 of the building and a U-shaped latch 36 is secured to the floor 34 below the termination of the guide rail 30.

Figure 2:
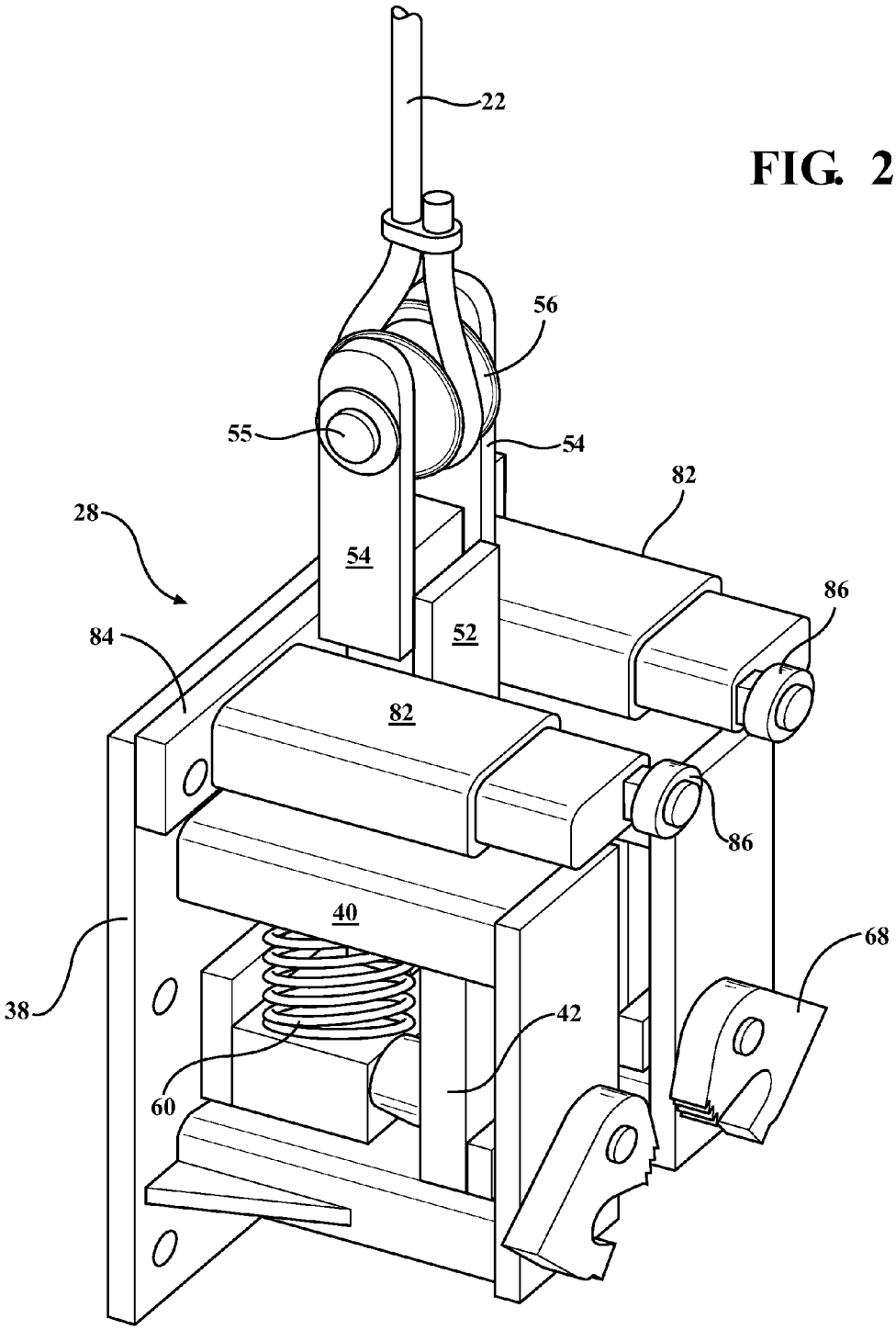
FIG. 2 is a perspective view of the fall arrestor in open position.
Figure 3:
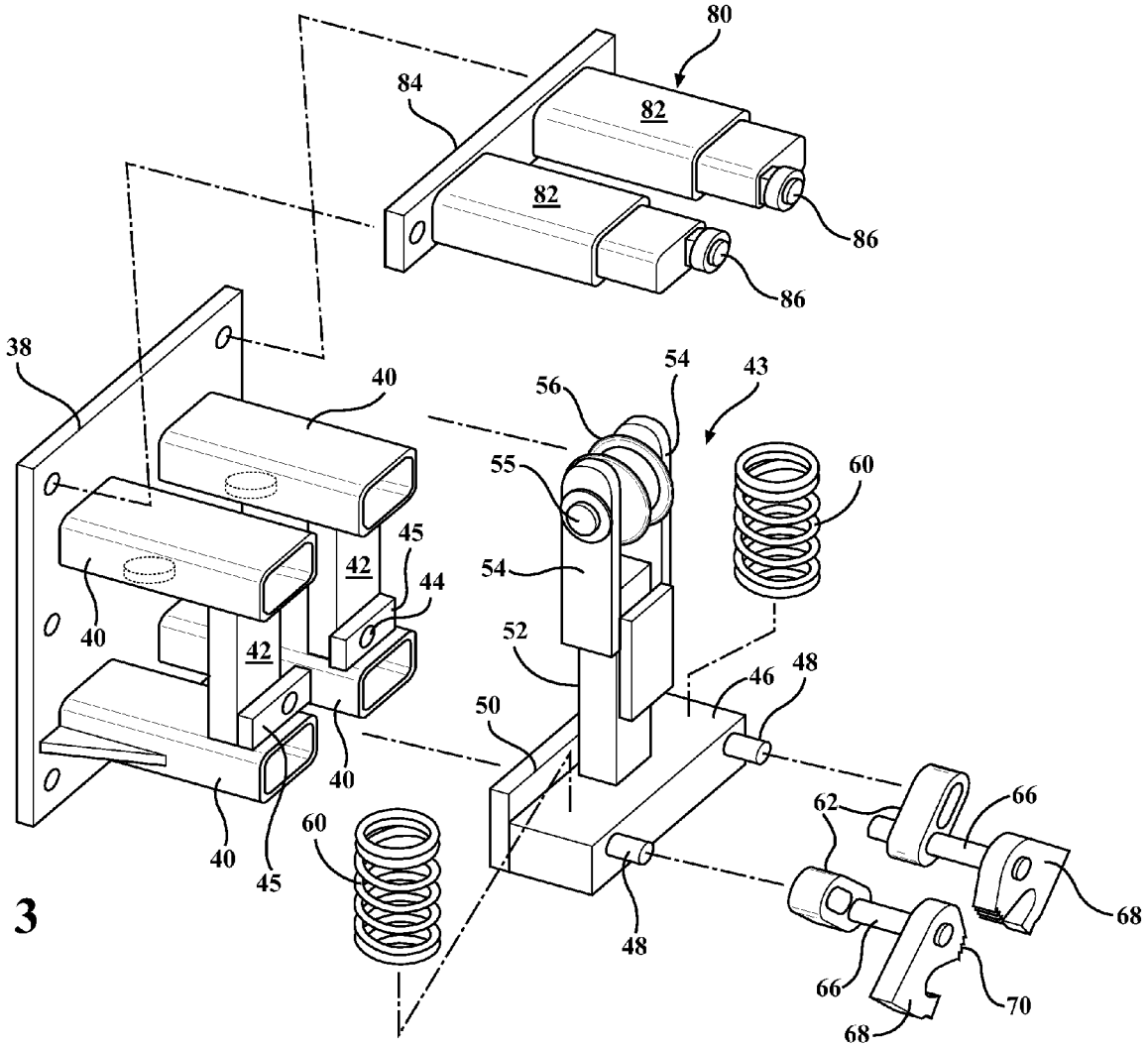
FIG. 3 is an exploded view of the fall arrestor assembly.

The fall arrestor 28, shown in assembled form in FIG. 2 and exploded form in FIG. 3, is supported on a plate 38 which attaches to the section of an L-shaped bracket 32 which extends outwardly from the door. The plate 38 has four rectangular tubes welded or otherwise joined to a surface of the plate 38 so that the tubes extend with their central axes normally to the plate. The upper and lower tubes 40 on each side of the plate 38 are separated from one another by a pair of blocks 42 which support plates 45 near their bottoms. The plates have holes 44 which support shafts 66.

Figure 4:
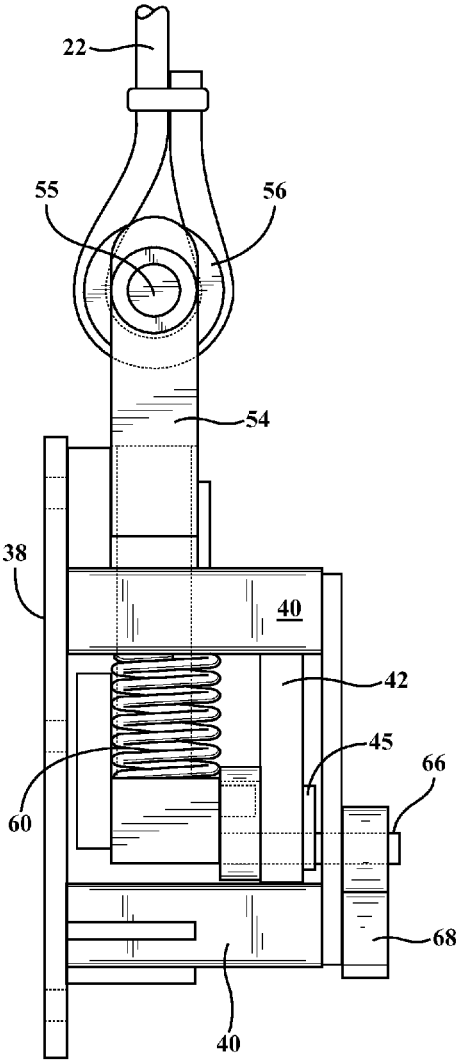
FIG. 4 is a side view of the fall arrestor.
Figure 5:
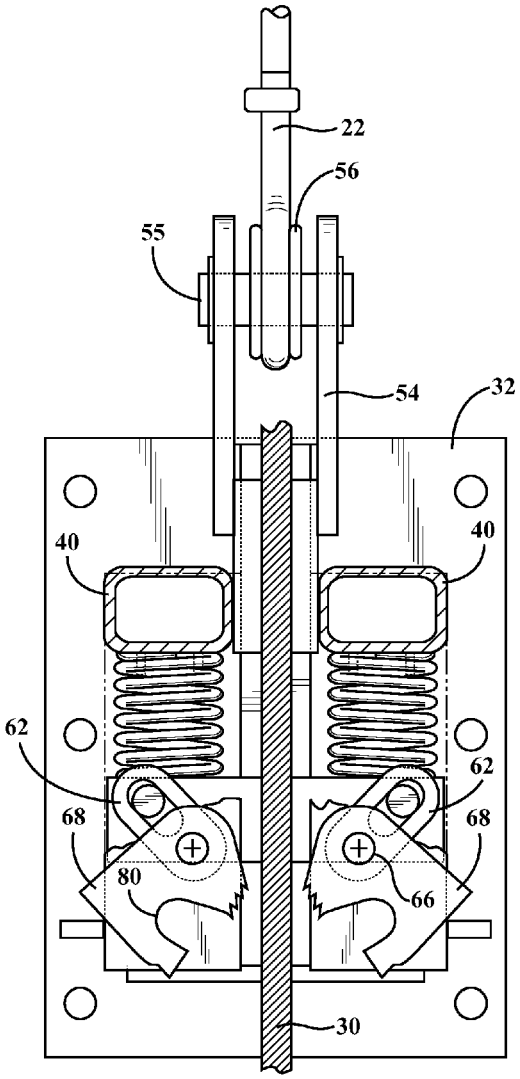
FIG. 5 is a front view of the fall arrestor in open position installed along a vertical rail.
Figure 6:
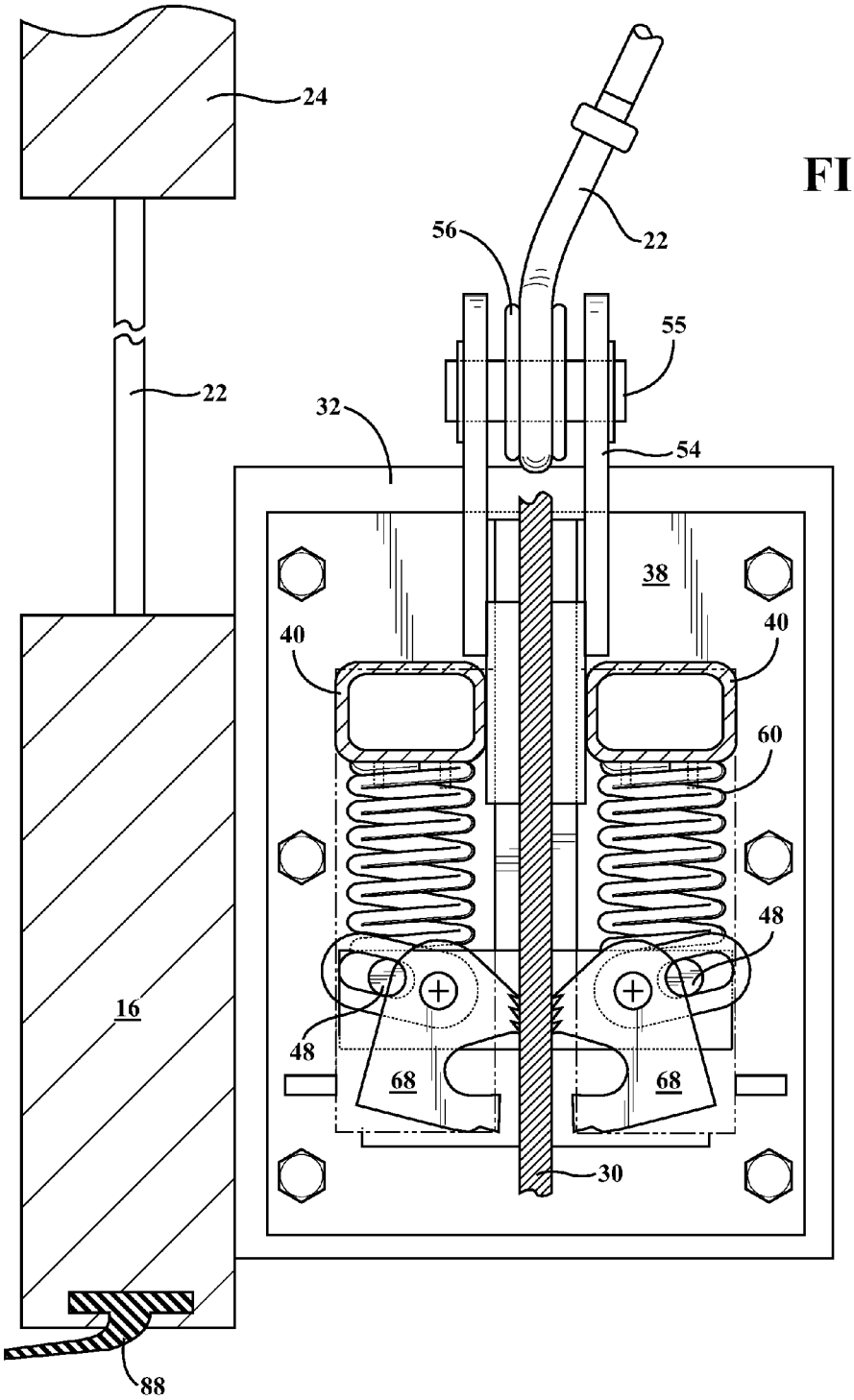
FIG. 6 is a front view of the fall arrestor after a catastrophic failure wherein the vertical lift door is prevented from free fall through the fall arrestor binding with the vertical rail.

A separate pulling bracket assembly, generally indicated at 43 in FIG. 3, is supported with respect to the bracket in a manner which will be subsequently disclosed. The lifting bracket assembly 43 comprises a base member 46, a pair of cylindrical cam followers 48 connected to its forward face on opposite sides of the base 46, and an upright post 52 projecting from the top of the base. A pair of plates 54 are connected to opposed sides of the post 52, near its top, and project upwardly therefrom. These members 54 support the ends of a post 55 for a ring 56 which secures the lower end of the cable 22 as illustrated in FIGS. 4, 5, and 6. As is best seen in FIG. 4, the lifting assembly 43 is supported with respect to the plate 38, above the top surface of the two bottom tubes 40. A pair of compression springs 60 have their lower ends resting on the base 46 and their upper ends secured respectively to the undersides of the two top tubes.

A pair of slotted cams 62 have their slots supported on the cam followers 48. Each of the slotted cams is rotatably supported about one of the shafts 66 projecting from the holes 44 in the support plates 45 and carries a latching dog 68.

In normal operation of the device, when there is tension on the cable 22 by virtue of it being retracted to lift the door, the springs 60 are compressed against the top tubes 40 in the manner illustrated in FIGS. 4 and 5. The cam followers then move the latching dogs 68 into an open position best seen in FIG. 5. In this position the vertical guide rail 30 is disposed in the open space between the latching dogs 68. However, in the event of a failure of the cable 22 there is no longer a lifting force on the base 46 carried through the post 52, and the compression springs 60 expand downwardly toward the top surfaces of the lower tubes 40. That downward motion drives the cam followers 48 to move in the slots in the cams 62 and cause the cams to rotate in opposed directions about the cam followers 48. This moves the cams against the guide rail 30, as seen in FIG. 6, locking the door against further movement.

The latching dogs 68 each have toothed surfaces 70. The teeth of these surfaces are preferably flame hardened for strong binding on the flange of the rail 30. The fall arrestor assembly of FIGS. 2 and 3 is completed by a guide assembly generally indicated at 80, comprising a pair of tubes 82 joined to a plate 84 fastened to the top of the plate 38. Each of the tubes 82 carries a roller guide 86 on its projecting end and these two roller guides bear against the guide rail 30 to maintain the fall arrestor assembly properly aligned with respect to the rail.

Figure 7:
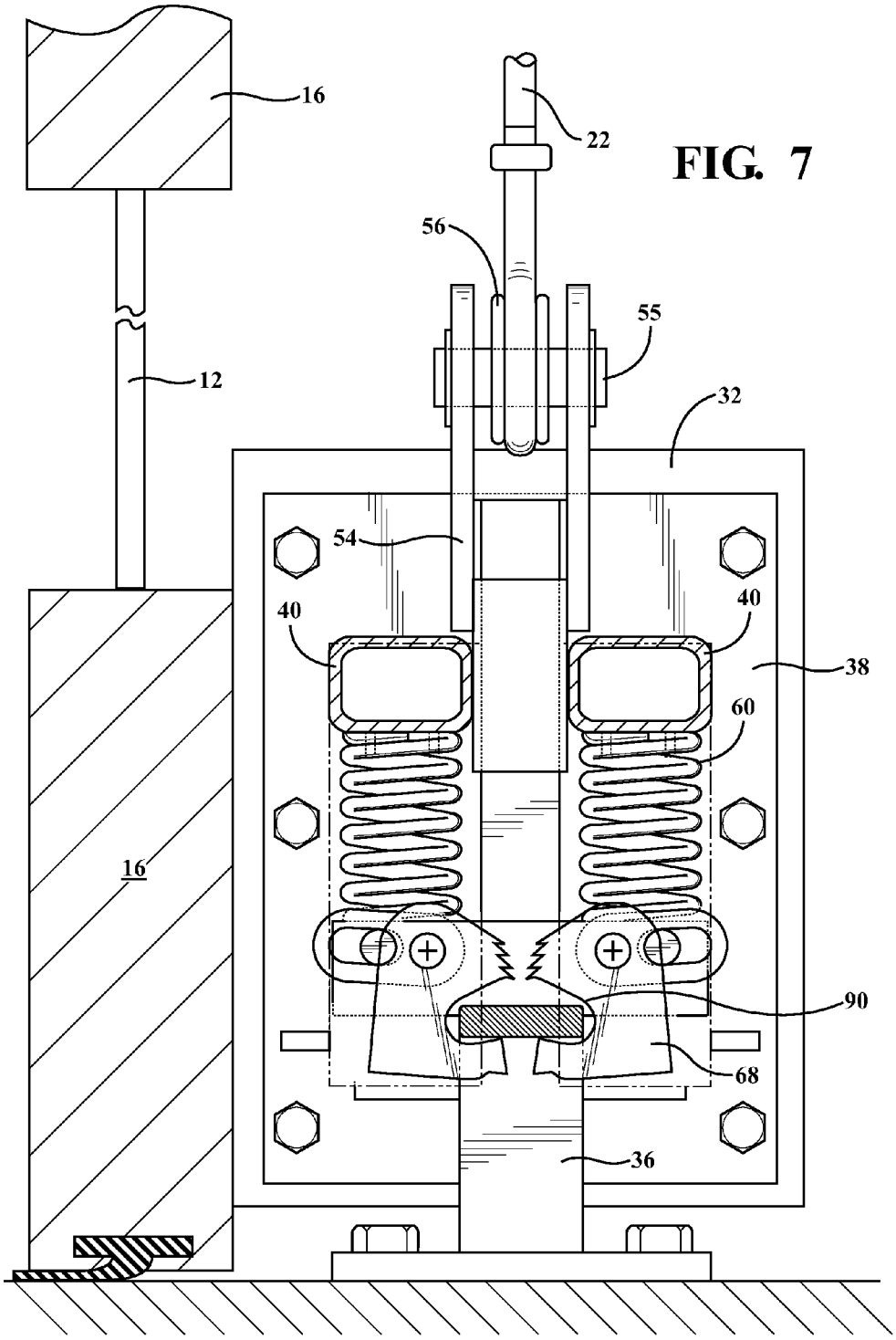
FIG. 7 is a front view of the fall arrestor when the vertical lift door is closed and the fall arrestor has locked with the ground locking bracket.

As illustrated in FIG. 7, when the door in normal operation is lowered to the bottom, and the tension on the cable is normally released, the latching dogs will rotate toward locked position, below the lower termination of the guide rail 30, and lock the door against lifting as a result of wind forces or the like by engaging opposed sides of the latch 36. The latching dogs 68 have throat portions 90, which surround the opposed sides of the latch 36 without the teeth 70 contacting the bracket. This avoids dulling of the teeth by constant use. A flexible seal 88 seated on the lower end of the lowest door rail 16 will then bear against the floor 34 to seal the opening 20.

Having thus described exemplary embodiments of the present invention, it should be noted by those skilled in the art that the within disclosures are exemplary only, and that various other alternatives, adaptations, and modifications may be made within the scope of the present invention. Further embodiments optionally comprise combinations of aforementioned embodiments. Accordingly, the present invention is not limited to the specific embodiments illustrated herein, but is only limited by the following claims.

The invention claimed is:

1. A fall arrestor for a vertical door having a planar vertical edge extending adjacent to a fixed vertical rail, and having a lift mechanism for lifting and lowering the door with a power driven mechanism connected to a first end of a lift cable, said fall arrestor comprising:

a first member connected to a second end of the lift cable and having a top surface;

a second member connected to the vertical edge of the vertical door and having a surface opposed to said top surface of the first member;

a first compression spring extending between said top surface of the first member and the opposed surface of the second member;

a pair of latching dogs pivotably supported with respect to the first member on opposite sides of said fixed vertical rail, the pair of latching dogs having an open position wherein said pair of latching dogs are separated from the vertical rail and a closed position wherein said pair of latching dogs bear against planar faces of the opposite sides of the vertical rail to lock the vertical door to the vertical rail, preventing motion of the vertical door relative to the vertical rail;

a pair of cam members rotatably supported on the first member and connected to the pair of latching dogs to place the pair of latching dogs in said open position when the top surface of the first member and the opposed surface of the second member are in a compression position, and to place the pair of latching dogs in said closed position when the top surface of the first member and the opposed surface of the second member are in a separated position; and wherein a weight of the vertical door, when being lifted or lowered, acts to impose tension on said lift cable to maintain the top surface of the first member and the opposed surface of the second member in said compression position, compressing the compression spring, and maintaining said pair of latching dogs in said open position, and when the vertical door is completely closed or the lift mechanism fails, the compression spring forces the top surface of the first member and the opposed surface of the second member apart and, acting through said cam members, forces the pair of latching dogs into said closed position, locking the vertical door to the vertical rail.

2. A fall arrestor according to claim 1 wherein said pair of latching dogs comprise flame-hardened teeth for binding on said vertical rail.

3. A fall arrestor according to claim 1 wherein said latching dogs engage a floor supported bracket when said vertical door is completely closed, locking said door against motion.

4. A fall arrestor according to claim 1 wherein said first member is connected to said second end of the lift cable through a pulling bracket.

5. A fall arrestor according to claim 1 wherein said lift cable is chosen from the group consisting of a steel cable, a rope, a strap, and a chain.

6. A fall arrestor according to claim 1 wherein said compression spring has a compression force less than a force generated by the weight of said vertical door.

7. A fall arrestor according to claim 1 further comprising a pair of guide rollers disposed on said opposite sides of said vertical rail to guide said vertical door during said lifting and lowering of the vertical door.

8. A fall arrestor according to claim 1 wherein said vertical rail terminates above the pair of latching dogs when the vertical door is completely closed and the pair of latching dogs do not engage the vertical rail.

9. A fall arrestor according to claim 1 comprising a second compression spring extending between said top surface of said first member and the opposed surface of said second member.

10. A fall arrestor according to claim 9 wherein said first member comprises a post extending at a right angle to the top surface of the first member and connecting to the second end of the lift cable.

11. A fall arrestor according to claim 10 wherein said compression springs are disposed on opposed sides of said post.

12. A fall arrestor according to claim 1 wherein the latching dogs are pivotably supported with respect to the first member on cylindrical cam followers extending from said first member.

* * * * *